United States Patent [19]

Futcher et al.

[11] 3,960,653

[45] June 1, 1976

[54] DOWNFLOW CONTROL SYSTEM FOR WEB MAKING MACHINES

[75] Inventors: Ralph James Futcher, Beaconsfield; Alexander Malashenko, Dollard des Ormeaux, both of Canada

[73] Assignee: Dominion Engineering Works, Limited, Lachine, Canada

[22] Filed: Dec. 5, 1974

[21] Appl. No.: 529,749

Related U.S. Application Data

[63] Continuation-in-part of Ser. No. 362,083, May 21, 1973, abandoned.

[52] U.S. Cl. ..... 162/264; 55/204; 162/190; 162/DIG. 7

[51] Int. Cl.[2] ..... D21F 1/68

[58] Field of Search ..... 162/264, 190, DIG. 7; 55/204, 205

[56] References Cited

UNITED STATES PATENTS

| | | | |
|---|---|---|---|
| 2,694,345 | 11/1954 | Hornbostel | 162/264 X |
| 3,163,508 | 12/1964 | Tuck et al. | 55/204 X |
| 3,403,073 | 9/1968 | Moran | 162/DIG. 7 |
| 3,771,290 | 11/1973 | Stethem | 55/205 |
| 3,801,435 | 4/1974 | Malashenko et al. | 162/DIG. 7 |

FOREIGN PATENTS OR APPLICATIONS

| | | | |
|---|---|---|---|
| 918,105 | 2/1963 | United Kingdom | 55/204 |
| 768,537 | 2/1957 | United Kingdom | 55/205 |
| 796,886 | 6/1958 | United Kingdom | 55/205 |
| 1,252,172 | 11/1971 | United Kingdom | 55/205 |

*Primary Examiner*—S. Leon Bashore
*Assistant Examiner*—Richard V. Fisher

[57] ABSTRACT

A whitewater system is provided for handling at high velocity the large quantities of water that are circulated in the high speed forming of pulp using a wire and forming wheel. Use of a centrifugal collector to transfer water from within a forming loop at velocities approaching that of wire speed permits the water to be partially deaerated automatically, so that return as white water to the pulping system is facilitated.

1 Claim, 3 Drawing Figures

DOWNFLOW CONTROL SYSTEM FOR WEB MAKING MACHINES

This application is a continuation-in-part of United States application Serial No. 362,083 filed May 21, 1973, now abandoned.

This invention is directed to a water transfer system for use in the making of pulp webs, and in particular a downspout for transferring at high speed large quantities of water released from a forming cylinder within the loop of a web forming band.

The high speed formation of webs in the making of paper, tissue and the like, particularly on single wire or twin wire machines operating in conjunction with a porous forming roll has led to considerable problems in handling the quantities of water released from the forming zone into a restricted space in the machine. Owing to high release velocities in the order of 3,000 ft/min. and the large flow rates involved, which may be in the order of 10,000 gallons per minute, and the desirability of returning to the stock system as rapidly as possible the water expressed during web formation it is necessary to deaerate as rapidly as possible this white water. A further problem involved with machines of this type particularly twin web formers, is the creation of Scotch Mist in the vicinity of the machine, which is disadvantageous to machine room conditions, and also contributes to adverse forming conditions.

A further problem to be overcome in handling large quantities of water between differing elevations is the "cascade" phenomena that tends to entrain large quantities of air therewith. This air presence is particularly undesired in the case of white water that is intended for immediate stock recycling.

One object of the present invention is to receive from within the confines of a wide band of limited length large quantities of water moving at high velocity, in the cross-machine direction, and to deflect such water from a cross-machine direction to a desired location adjacent the machine, while managing to maintain the large momentum of flow of water as ejected from the periphery of a porous roll, after deflection of the water transversely from the web loop, and to utilize the transverse velocity of the water when making a second change in direction in accordance with the present invention to assist in deaerating the water, and to assist in entraining and removing dispersed droplets with the entrained air.

One solution for effecting the transverse removal of water from a web loop is provided in U.S. Pat. No. 3,801,435 Malashenko et al, issued Apr. 2, 1974, which results in a high velocity flow of mixed fluid flowing transversely and generally horizontally from one side of the web loop. This flow is at substantially atmospheric pressure and includes liquid with large volumes of air in partially separated relation from the liquid.

The liquid, referred to generally as white water, may contain significant variations in solid content, depending on the characteristics of the web former in use. One of the advantages of the present invention, in addition to fastening the separation of gaseous components at low pressure drop and high volume flow from the high volume high velocity flow of the liquid, also resides in the turbulation afforded the substantially deaerated liquid, so as to cause mixing of the liquid to a more homogeneous consistency.

The present invention thus provides a method of dewatering a wide web forming machine having a cellular roll releasing a machine-width transversely disposed jet of water at high velocity in a substantially tangential direction relative to the periphery of the roll within the loop of an endless web forming band of restricted length passing over the roll, comprising the steps of collecting the water and converting it to at least one concentrated high velocity flow moving in a first direction outwardly from the loop, directing the flow to a second direction inclined from the first direction and imparting a centrifugal acceleration to the flow while continuing to move in the second direction to provide high velocity swirl with movement about an inner surface of an inclined drain extending in the second direction, and venting a centre portion of the drain in a direction opposed to the water flow to permit the passage of air therefrom and to entrain therewith vapour from the centre portion, so as to at least initially deaerate the water for subsequent recirculation to a stock supply system. In order to carry out the invention there is provided fluid flow control means, including an inclined downspout having a side entry intermediate the ends thereof arranged in asymmetrical off-centered relation relative to the drain axis, a water removal exit located downwardly of the entry, relative to the drain axis, and a gaseous fluid removal exit communicating with a central core portion of the drain, the radius of curvature of the drain being a function of water flow velocity to ensure sustained water swirl along at least a portion of the drain and to procure sustained centrifugal separation of water from air with water vapour, for removal of the gaseous fluid upwardly from the drain.

It will be understood that the stabilized level of water within the inclined drain is influenced in part by flow conditions downstream of the drain. One further characteristic of the drain is that the downward flow velocity component is markedly modified by the maintenance of horizontal velocity as a horizontal swirl component. This permits the use of the drain as a drop leg to the level of a wire pit or holding tank, without the occurrence of cascading and consequent air entrainment.

While various types of cross-machine savealls may be used in order to first redirect the transversely dispersed jet into a concentrated flow, Applicant has enjoyed considerable success using a wrap-over saveall having an egg-shaped outflow cross-section, with a top entry mouth extending the full width of the machine in spiralled relation with the egg-shaped out-flow section, a plurality of flow dividers extending in jet dividing relation across the entry mouth, being inclined to the sides of the mouth and helically wrapped towards the direction of concentrated outflow. A saveall as described is disclosed in Canadian Pat. No. 937,084 issued Nov. 20, 1973 in the name of Malashenko et al corresponding to U.S. Pat. No. 3,801,435.

Certain unobvious advantages that are obtained in using the present system include the enhanced white water supply situation, wherein the size of holding tank necessary to provide sufficient deaeration of returned white water is markedly reduced, thus saving in prime cost and space, together with effective removal of mist and spray from the vicinity of the machine, using only the water disposal system. Furthermore, the quality of the white water is made more homogeneous, to facilitate stock preparation.

Certain embodiments of the invention are describe, reference being made to the accompanying drawings, wherein.

Figure 1:
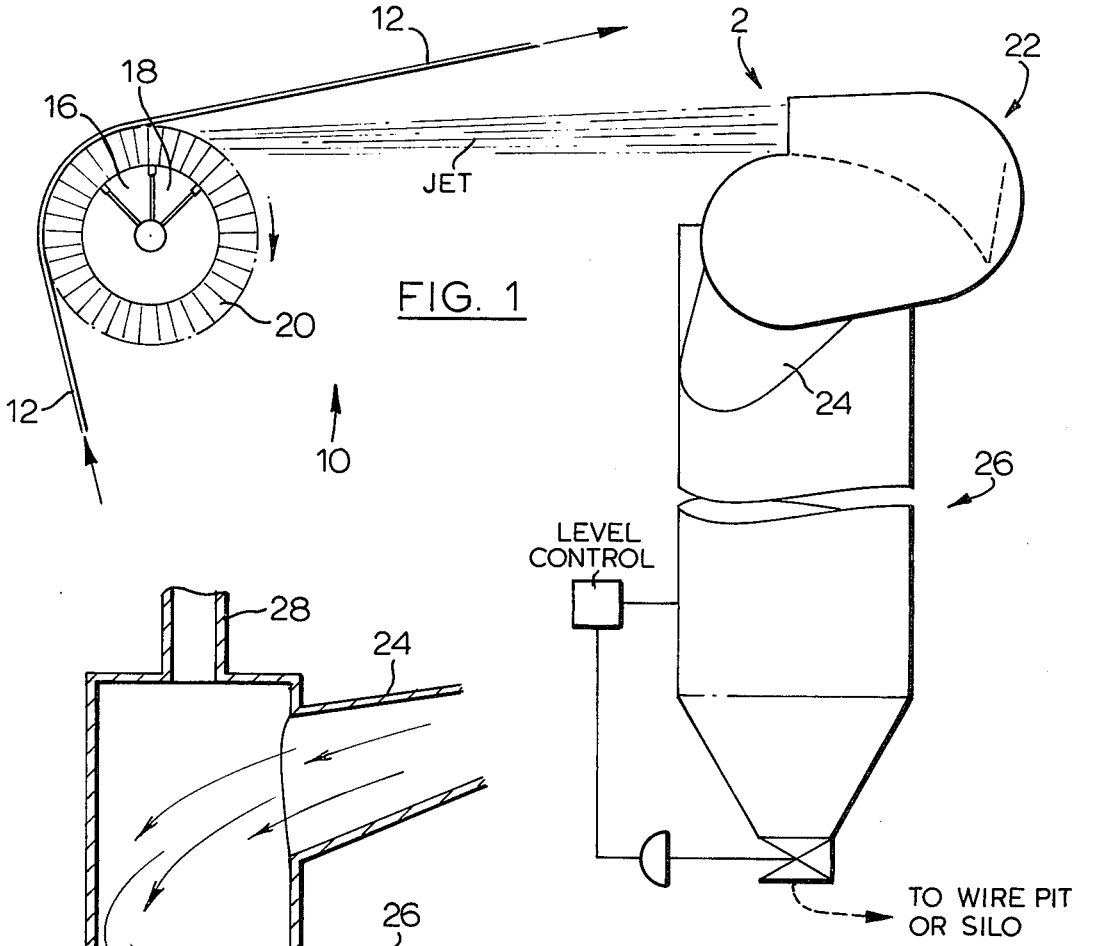
FIG. 1 is a side view of part of a web forming machine incorporating the present invention.
Figure 2:
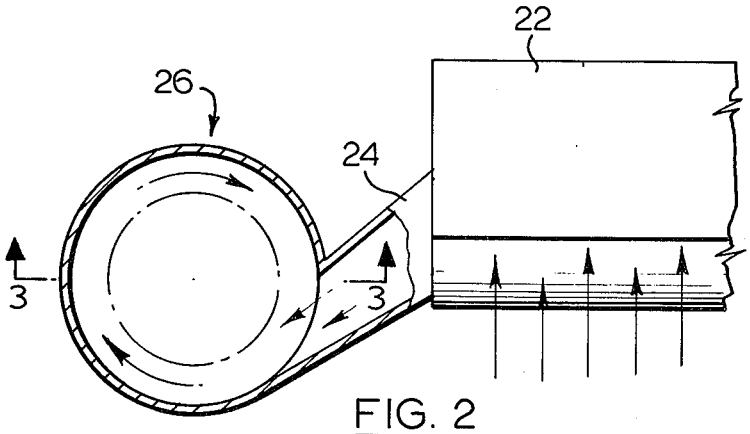
FIG. 2 is a partial plan view taken in the direction 2 of FIG. 1.
Figure 3:
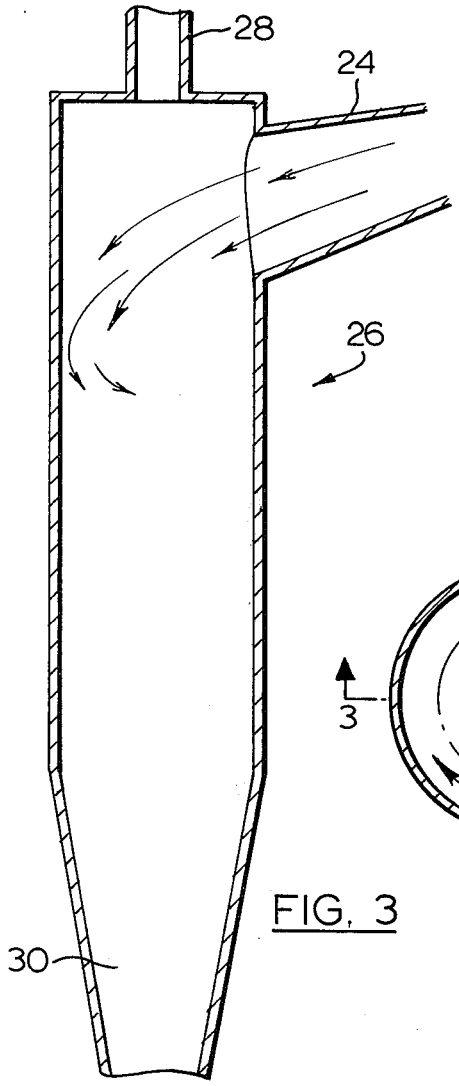
FIG. 3 is a section of the line 3—3 of FIG. 2.

In the arrangement 10 of FIG. 1, a travelling fourdrinier wire 12 or like forming band passes around a forming roll 14 having suction zones 16, 18 therein, and a cell-like roll periphery 20 to receive water therein. The roll periphery may be drilled to provide the requisite cellular structure to receive water therein.

A water jet is released from the periphery 20 of the roll 14 and enters a saveall 22 wherein the water is deflected sideways as a concentrated flow with large quantities of air and water vapour in partially separated condition, to enter a transition channel 24. The channel 24 connects substantially tangentially with the flow controller or downspout 26, wherein the water is caused to circulate, thereby obtaining a compound velocity having a relatively small vertical component of flow and high swirl velocity. Initially, upon entry into the downspout the segregated air and water vapour flows freely as an updraft through an outlet 28. The swirl velocity produces separation of entrained air entering the controller 26, under centrifugal force, and further promotes the updraft through the top flow outlet 28, with water flowing through the bottom outlet 30. By virtue of the centrifugal flow component there is a much reduced tendency for the downflowing water to entrain air, as is the case for a plain elbow connection. The upflowing air is generally assisted by fan to flow to a vent or other appropriate disposal zone, serving also to entrain dispersed water droplets and vapour therewith, so that the environment of the machine is kept substantially free of misting effects that otherwise often occur.

A water level control responsive to the level in the flow controller 26 may be installed as illustrated, in controlling relation with a valve located in the drain connected to the bottom outlet 30, to maintain the level within flow controller 26 at an optimum value for deaeration purposes.

Reference is made herein to a wide machine, to distinguish an operative web making arrangement having a forming roll ranging from a few feet up to thirty feet or so in length, as distinct from a laboratory machine of thirty inches or so in roll length. It will be understood in the case of a machine having such wide wires, particularly where the loop length is kept as short as possible, that satisfactory dewatering of the forming roll periphery to remove the water clear of the closely confined space within the running wire loop is a difficult task requiring an unusual solution.

As the distance downwardly from the machine to the white water holding tank may be considerable, the avoidance of undue aeration by high velocity cascading in the down pipe is of considerable significance in improved machine operation. Also the turbulation applied to liquid and solid components which constitute the white water, serve to more thoroughly mix and unify the homogeneity of the white water. In a flow system which also receives shower water with the incoming white water, the mixing provided by the downspout can be of considerable benefit in white water handling equipment and stock preparation equipment.

What we claim as new and desire to secure by Letters Patent of the United States is:

1. A downspout device in combination with a paper machine for transferring to a white water tank at a lower level liquid flowing as a high velocity liquid jet at substantially atmospheric pressure together with significant quantities of air and vapourous components in partially separated relation therewith, said jet being directed by the machine substantially horizontally out of the machine towards the device at a first level for subsequent flow of the liquid in a substantially non-cascaded condition at a second level below said first level, comprising a tube having an upper end, a lower end, and a substantially unobstructed interior extending between said first and second levels, having water entry means at said first level spaced from said upper end of the tube to provide an air space within the tube extending above said entry means, and to receive said liquid and air, said entry means having a downwardly sloping lower surface to impart a downward component of liquid flow velocity, said entry means being located in off-centered relation to the main longitudinal axis of said tube, to provide in operation a tangential flow component to liquid entering the downspout device and to permit unobstructed up draft of said air and vaporous components entering through said entry means, a first outlet from said tube, located at said second level and a second substantially unrestricted outlet in said tube, located above said entry and connecting with said air space, to receive in operation an air and water vapour up-draft at substantially atmospheric pressure, including air separated from said liquid by the centrifuge effect of high velocity rotation of said liquid flowing over the inner surface of the tube and downwardly along the downspout device.

* * * * *

UNITED STATES PATENT OFFICE

CERTIFICATE OF CORRECTION

Patent No. 3,960,653 Dated June 1, 1976

Inventor(s) Ralph James Futcher et al.

It is certified that error appears in the above-identified patent and that said Letters Patent are hereby corrected as shown below:

On the cover sheet insert:

(30) Foreign Application Priority Data

Canada 147,333 July 18, 1972

Signed and Sealed this

Twenty-first Day of September 1976

[SEAL]

*Attest:*

RUTH C. MASON
*Attesting Officer*

C. MARSHALL DANN
*Commissioner of Patents and Trademarks*